US005913764A

United States Patent [19]

Kolbe et al.

[11] Patent Number: 5,913,764

[45] Date of Patent: Jun. 22, 1999

[54] METHOD OF MANUFACTURING FLAT-BOTTOM BAGS WITH A GLUED-ON BOTTOM LINING

[75] Inventors: Wilfried Kolbe, Gülzow, Germany; Hans-Rudolph Van Den Maagdenberg, Kesteren, Netherlands; Günter Niemeyer, Bielefeld, Germany; Diethard Obermeier, Bad Salzuflen, Germany; Klaus Schirrich, Bielefeld, Germany

[73] Assignee: Fischer & Krecke GmbH & Co., Bielefeld, Germany

[21] Appl. No.: 08/981,342

[22] PCT Filed: Apr. 11, 1996

[86] PCT No.: PCT/EP96/01540

§ 371 Date: Dec. 19, 1997

§ 102(e) Date: Dec. 19, 1997

[87] PCT Pub. No.: WO97/00768

PCT Pub. Date: Jan. 9, 1997

[30] Foreign Application Priority Data

Jun. 22, 1995 [DE] Germany ..... 195 22 619

[51] Int. Cl.[6] ..... B31B 1/90

[52] U.S. Cl. ..... 493/218; 493/264; 493/267; 493/331; 493/334; 493/936

[58] Field of Search ..... 493/210, 214, 493/217, 218, 231, 243, 244, 245, 253, 255, 258, 260, 261, 264, 267, 268, 374, 379, 382, 383, 390, 391, 393, 394, 328, 331, 333, 334, 907, 921, 922, 936

[56] References Cited

U.S. PATENT DOCUMENTS

| | | | |
|---|---|---|---|
| 333,523 | 1/1886 | Honiss | 493/936 |
| 596,373 | 12/1897 | Lorenz | 493/936 |
| 692,695 | 2/1902 | Mullen | 493/936 |
| 3,397,622 | 8/1968 | Goodwin . | |
| 3,896,708 | 7/1975 | De Vries | 493/936 |
| 3,927,606 | 12/1975 | Brockmuller | 493/936 |
| 4,156,398 | 5/1979 | McDaniel | 493/331 |
| 4,235,158 | 11/1980 | Johnson | 493/334 |
| 5,102,383 | 4/1992 | Achelpohl | 493/936 |
| 5,102,384 | 4/1992 | Ross | 493/936 |
| 5,149,315 | 9/1992 | Muhs | 493/261 |
| 5,314,252 | 5/1994 | Happ . | |
| 5,549,538 | 8/1996 | Marsik . | |

FOREIGN PATENT DOCUMENTS

| | | |
|---|---|---|
| 2393673 | 6/1977 | France . |
| 1146348 | 3/1963 | Germany . |
| 1248912 | 8/1967 | Germany . |
| 2514219 | 10/1976 | Germany . |
| 4323927 | 1/1995 | Germany . |
| 303295 | 11/1954 | Switzerland . |
| WO9502544 | 1/1995 | WIPO . |

*Primary Examiner*—Linda Johnson
*Assistant Examiner*—Matthew Luby
*Attorney, Agent, or Firm*—Richard M. Goldberg

[57] ABSTRACT

A method for manufacturing flat-bottom bags with a glued-in bottom lining includes the steps of applying a contact adhesive, which develops a desired adhesive force only when two surfaces, both of which are coated with the contact adhesive, are pressed against one another, onto a starting material for the bag, subsequently closing the starting material into a tube, supplying the tube to a bottom-laying station to produce a flat-positioned bottom of the bag, and completing gluing by exertion of pressure on the flat-positioned bottom of the bag after the bottom lining has been placed upon the flat-positioned bottom.

15 Claims, 4 Drawing Sheets

METHOD OF MANUFACTURING FLAT-BOTTOM BAGS WITH A GLUED-ON BOTTOM LINING

BACKGROUND OF THE INVENTION

The invention relates to a method for manufacturing flat-bottom bags with a glued-in bottom lining.

In the case of flat-bottom bags, such as block flat-bottom bags or cross flat-bottom bags of paper, plastic film or the like, the bottom flaps form, on the inside of the bag, undesirable hollow spaces, such as gaps or pockets, in which powdery, grainy or pasty residues of the contents of the bag can collect. It is therefore known that a so-called bottom lining may be glued into the bottom of the bag on the inside. Usually, this bottom lining is formed by a rectangular sheet of the bag material and is glued or welded all around to the bottom flap, so that the hollow spaces are closed off from the interior of the bag.

The WO 95/02544 discloses a method for manufacturing such bags, in which the bag material, as well as the bottom lining, consists of paper coated on the inside with polyethylene. According to this method, the bottom lining is glued at the edges, which run parallel to the narrow edges of the bag, to the associated bottom flap and, parallel to the edges at the broad side of the bottom, the mutually facing coated surfaces of the bottom lining and the bottom flap are welded together by means of continuous weld lines.

However, the gluing or welding of the bottom lining generally is relatively difficult and expensive technologically because there is no direct access to the inside of the bottom for the tools required. The weldings are therefore generally carried out with the bottom placed flat, so that there are several layers of material of the bottom between the welding tools. Generally, therefore, by suitably controlling the process or by inserting separator sheets or the like, it is ensured that the welding takes place selectively only at the desired places and that material layers, which must be separated from one another once again later on when the bag is being filled, are not welded together. Similar problems also arise with gluings, because the adhesive, usually glue or a hot melt adhesive, must be applied in such a manner during the manufacturing process, that undesired glued sites do not result and that the bottom flaps are not smudged with adhesive when the bottom lining is put in place.

The usual method for manufacturing flat-bottom bags consists therein that the starting material, in the form of an endless sheet, is pulled off from a roll and then, initially, closed into a tube, which is then divided into sections of suitable length for forming the individual bags. The pieces of tube, so obtained, are supplied continuously to a rotating bottom-laying drum, at which an opening station, a bottom-laying station and a closing station are disposed consecutively in the circumferential direction. In the opening station, the upper and lower layers of the tube, which initially lie flat on top of one another, are pulled apart at the bottom end, so that a wide open bottom opening results. In the bottom-laying station, the edges of this bottom opening, opposite to one another in the running direction, are pulled apart and the longitudinal edges are folded over, so that bottom flaps are formed, which partially overlap one another and lie flat against the periphery of the bottom-laying drum. The outwardly-folded flaps are then folded over in the closing station and, by means of a final gluing, glued together so that a closed bottom is obtained.

If the bottom is to be provided with a bottom lining, then this lining must be introduced into the bottom opening between the opening station and the bottom-laying station and then welded to or glued to the bottom flaps. Due to the gluing and/or welding facilities required for this purpose, the construction of the apparatus is made considerably more complicated and, since the additional steps of the process, such as the application of the glue, the production of the weld lines and the like, require a certain amount of time, the total processing time is increased so that only a correspondingly lower output of bags can be achieved in the continuous manufacturing process.

SUMMARY OF THE INVENTION

It is therefore an object of the invention to provide a method which, with a relatively simply constructed plant, permits rational continuous manufacture of bags with a glued-in bottom lining.

Pursuant to the invention, this objective is accomplished owing to the fact that, for the bottom lining, a contact adhesive is used, which develops its desired adhesive force only when two surfaces, both of which have already been coated with the contact adhesive, are pressed against one another, that the contact adhesive is applied on the starting material, from which the bag is made, before this material is closed into a tube and passed on to a bottom-laying station and that the gluing is completed by exerting pressure after the bottom lining, provided with contact adhesive, has been placed on the bottom, which has been laid out flat.

The inventive method thus has the advantage that the adhesive, required for gluing in the bottom lining, can be applied on the material, from which the bag is made, before the tube is closed. Since the contact adhesive does not adhere until two surfaces, coated with this contact adhesive, are pressed together, it is possible to avoid undesirable adhesions while the starting material is being closed into a tube and during the following processing. Only after the bottom lining, which has also been provided with contact adhesive at the appropriate surfaces, has been placed down, can the contact adhesive become effective. Moreover, the bottom linings can also be coated with contact adhesive before they are supplied to the bottom-laying drum, so that, at the bottom-laying drum itself, additional time for applying the adhesive at places that are difficult to reach is not required and appropriate application devices do not have to be provided at the periphery of the bottom-laying drum. When the bottom is put in place and closed subsequently, the surfaces of the bottom lining and of the bag, which have been coated with contact adhesive, come into contact with one another. Since pressure is usually anyhow exerted on the bottom of the bag in conjunction with the closing of the bottom flaps and the final gluing, the contact adhesive becomes effective so that the bottom lining and the bottom flaps are glued together tightly, no additional measures being required for this purpose. In this way, it becomes possible to glue in the bottom lining in an extremely rational manner and a high output of the bag manufacturing machine can be achieved.

Advantageous further developments and refinements of the invention are given in the dependent claims.

For the manufacture of block flat-bottom bags, the tube, formed from the starting material, usually is provided with a side fold pulled inwards. In this case, it is advisable to have the transporting means, such as rollers or the like, which bring about the further transport of the tube or tube pieces to the bottom-laying drum, take hold in the region of the side folds. Since the areas, coated with contact adhesive, are separated there from one another by the side folds, there cannot be any premature activation of the contact adhesive due to the pressure exerted by the transporting means.

Alternatively, moreover, it is possible to dispose the surfaces, coated with contact adhesive, offset to one another on the top and bottom material layers of the tube, so that they do not come directly into contact when the tube is closed and placed flat. In this case, the transporting means can also take hold of the regions of the tube or tube pieces, which are not separated by side folds.

BRIEF DESCRIPTION OF THE DRAWINGS

A preferred example of the invention is explained in greater detail in the following by means of the drawings, in which.

DESCRIPTION OF THE PREFERRED EMBODIMENTS

Figure 1:
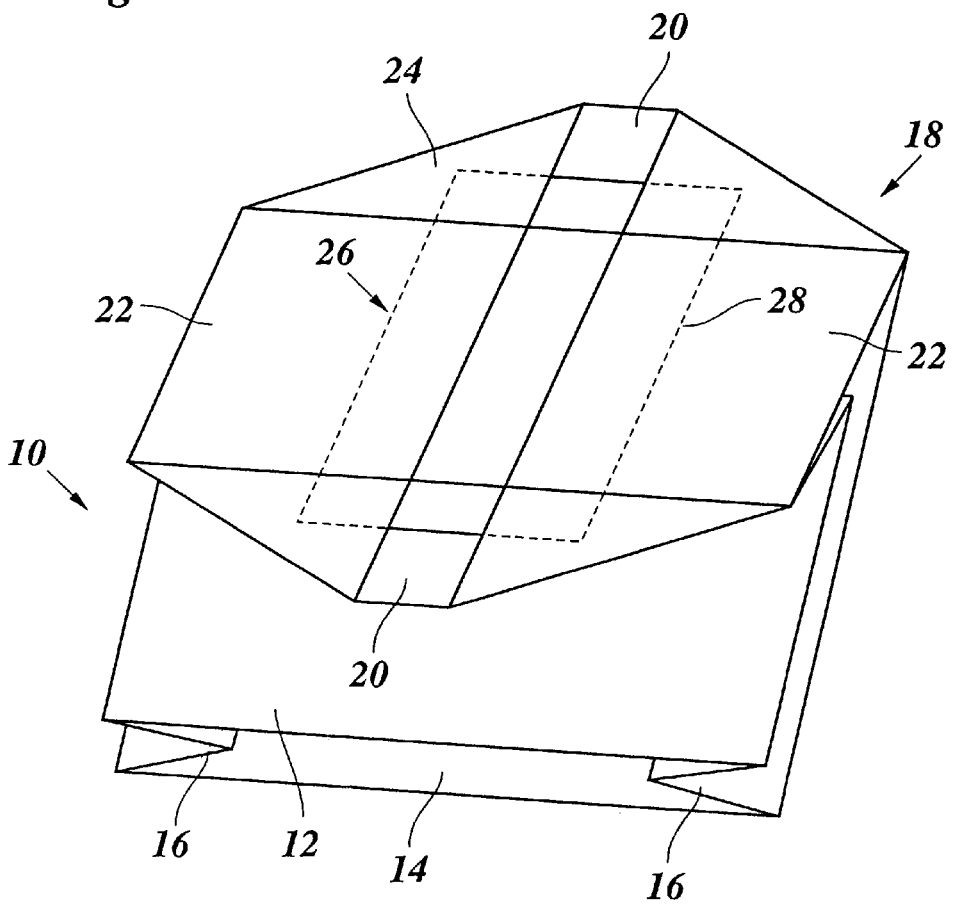
FIG. 1 shows a perspective view of the bottom region of a bag with bottom lining immediately before the final gluing.

In FIG. 1, the bottom region of a block flat-bottom bag 10 is shown, which consists, for example, of paper and is coated on the inside with plastic (such as polyethylene). The bag has an upper wall 12 and a lower wall 14, which are connected together by side folds 16, as well as a bottom 18 with a rectangular outline which, in the state shown, has not yet been closed. The bottom 18 is formed by four bottom flaps, formed in one piece with the main part of the bag, namely two trapezoidal flaps 20, protruding from the top and bottom walls of the bag, and two rectangular flaps 22, forming an extension of the side folds 16. The trapezoidal flaps 20 and the rectangular flaps 22 hang together over triangular tucks 24, which are folded back onto the trapezoidal flaps 20.

Furthermore, the bottom has a bottom lining 26, which is formed from a separate sheet of paper and also coated on the inside with polyethylene. This bottom lining 26 is glued at its longitudinal edges 28 to the inner surfaces of the rectangular flaps 22 and of the triangular tucks 24 and, furthermore, at its narrow sides, to the areas of the trapezoidal flaps 20 pointing upward in FIG. 1.

To close the bottom 18, the trapezoidal flaps 20 are folded inwards over one another in a known manner and glued together.

Figure 2:
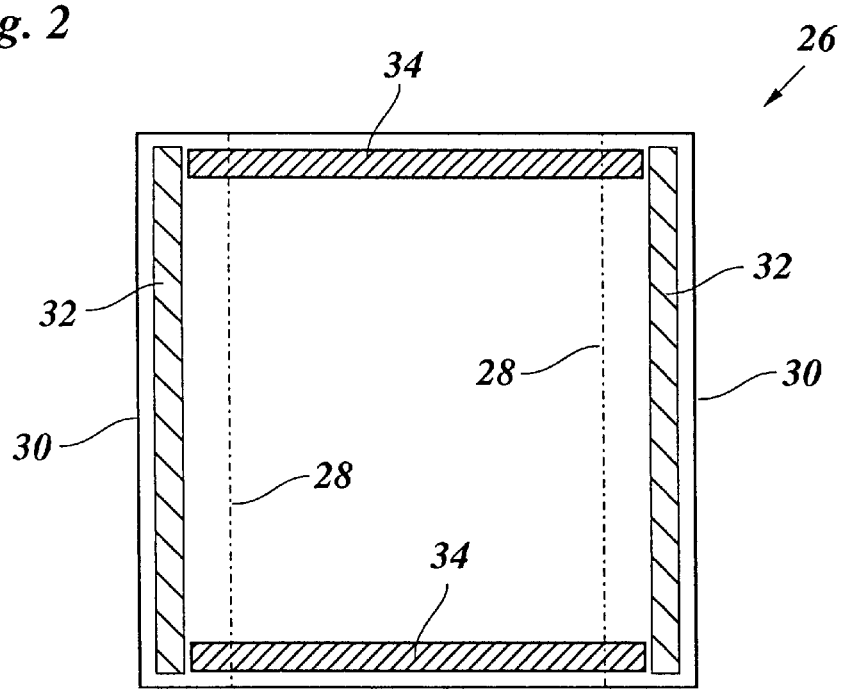
FIG. 2 shows the arrangement of adhesive-coated surfaces on a blank for the bottom lining.

FIG. 2 shows the blank, square in outline, for the bottom lining 26. The area of the blank, visible in FIG. 2, is the inner surface, which is coated with polyethylene and points downwards in FIG. 1. The blank has two lateral flaps 30, which are folded over later on towards the rear, so that the corresponding fold lines form the longitudinal edges 28 of the bottom lining. A glue or hot-melt adhesive is applied in the form of glue lines 32 on the flaps 30. By means of these glue lines 32, the folded-over flaps 30 of the bottom lining are glued to the rectangular flaps 22 and the triangular tucks 24 in FIG. 1. As shown in FIG. 2, two further glue lines 34 run parallel to the two other edges of the blank. These glue lines 34 are formed by contact adhesive and serve for gluing the bottom lining to the trapezoidal flaps 20 as well as—in the region of the flaps 30—to the triangular tucks 24.

Figure 3:
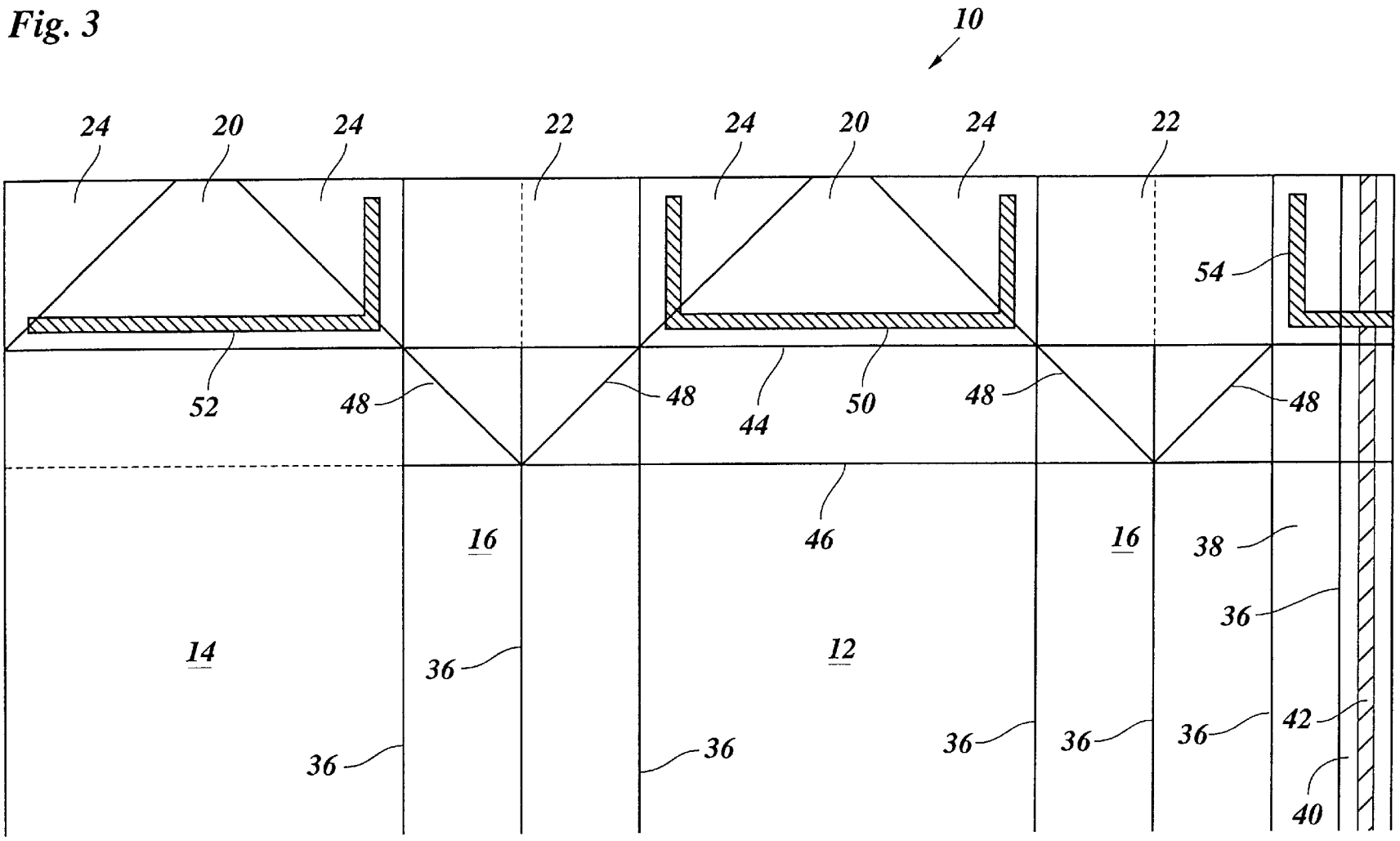
FIG. 3 shows the arrangement of adhesive-coated areas on the starting material for the bag.

The bottom region of a blank for the actual bag 10 is shown in FIG. 3. Here also, the visible part of the blank corresponds to the coated inner side of the bag. The blank is divided by longitudinally extending fold lines 36 into several fields, which form the upper wall 12, the lower wall 14 and the side folds 16 of the finished bag of FIG. 1. Furthermore, a fin 38 and a gluing flap 40 are formed at the right edge of the blank of FIG. 3 by these fold lines 36 and provided with a glue line 42 of glue or hot-melt adhesive. The fin 38 and the gluing flap 40 are folded over at the associated fold lines 36 in each case through 180° in opposite directions and the gluing flap is then glued to the edge of the wall 14, which is the left edge in FIG. 3, so that the blank is closed into a tube with the formation of a so-called fin seam. The use of a fin seam has the advantage that the gluing flap 40 comes to lie with its polyethylene-coated side on the also coated side of the wall 14, so that the bag is lined continuously on the inside with polyethylene and the paper, through which moisture could penetrate due to a wicking effect, has no connection with the interior of the bag.

The trapezoidal flaps 20 and the rectangular flaps 22 are separated from the main part of the bag by a transversely extending fold line 44. A further transversely extending fold line 46, which permits the bottom 18 to be shifted in the manner shown in FIG. 1 into the plane of the upper and lower walls 12, 14, is provided parallel to the fold line 44 in the region of the upper wall 12 and of the side folds 16. In the region of the lower wall 14, this fold line 46 is shown only by a broken line, because the material is not folded there in the state shown in FIG. 1. Correspondingly, the longitudinally extending fold lines 36 are also shown only as broken lines in the region of the rectangular flaps 22. The material is folded here only temporarily during the manufacture of the tube and the folds are undone once again later on.

The diagonally extending fold lines 48 separate the triangular tucks 24 from the trapezoidal flaps 20 and, in the region of the side walls 16, furthermore form additional triangular tucks, which permit the side folds to adjoin the rectangular bottom 18 in the manner shown in FIG. 1.

The trapezoidal flaps 20, lying in an extension of the upper wall 12, and the adjacent triangular tucks 24 are provided with a U-shaped glue line 50, which is formed by a contact adhesive and forms the counter-piece to one of the glue lines 34 of the bottom lining 26. The other trapezoidal flaps 20, as well as the fin 38 and the adhesive flap 40 are provided in a corresponding manner with L-shaped glue lines 52, 54 of contact adhesive, which together form the counter-piece for the other glue line 34 of the bottom lining 26.

The bag 10, together with a plurality of similar bags, is manufactured in a continuous method in the following manner.

The starting material, which forms the blanks for the bags 10, is pulled as an endless sheet from a roll. The outer side of the sheet, consisting of paper, can be printed with an inscription or some other imprint. The glue lines 50, 52 and 54, consisting of contact adhesive, can also already be printed on the sheet drawn off from the roll, since the contact adhesive adheres only when it is pressed against a surface also coated with contact adhesive. In the rolled-up sheet, however, the contact adhesive comes into contact only with the non-adhering paper side of the next layer of the sheet.

If the sheet has not yet been printed with the contact adhesive, the latter is printed or applied in some other way in the desired pattern on the sheet pulled off from the roll, after which the sheet, if necessary, passes through a drying station.

The sheet then passes through a gluing station, in which the glue line 42 of hot-melt adhesive is applied.

Subsequently, the sheet is folded along the fold lines 36 and glued into a tube. The glue lines 50 and 52, 54 then come to lie directly on top of one another, however, they do not adhere to one another until a pressure is exerted. Transporting rollers T for transporting the tube further take hold of the tube in the vicinity of the longitudinal edges, where the mutually opposite sections of glue lines 50 and 52, 54 are separated from one another by the side folds 16 that lie in between. Consequently, these transporting rollers also do not bring about premature adhesion of the contact adhesive.

The continuously transported tube is then cut in stamping or cutting equipment into tube pieces to form the individual bags and the fold lines 44, 46, 48, if necessary, are pre-grooved with the help of pre-grooving tools.

Subsequently, the tube pieces run onto a bottom-laying drum similar to that commonly used for the manufacture of flat-bottom bags.

The tube pieces are clamped onto the peripheral surface of the bottom-laying drum D and, on the bottom-laying drum, pass by an opening station, where the leading, bottom end of the tube is opened. The rectangular flaps 22 and the trapezoidal flaps 20 together then form with the triangular tucks 24 an approximately box-shaped bottom opening, as shown in FIG. 4.

Parallel with this, sheet material for the bottom lining 26 is drawn off from a different roll, provided with glue lines 34 of contact adhesive, dried if necessary and then cut to length. Subsequently, the flaps 30 are folded over and the folded-over flaps are provided with the glue lines 32 of glue or hot-melt adhesive.

Figure 4:
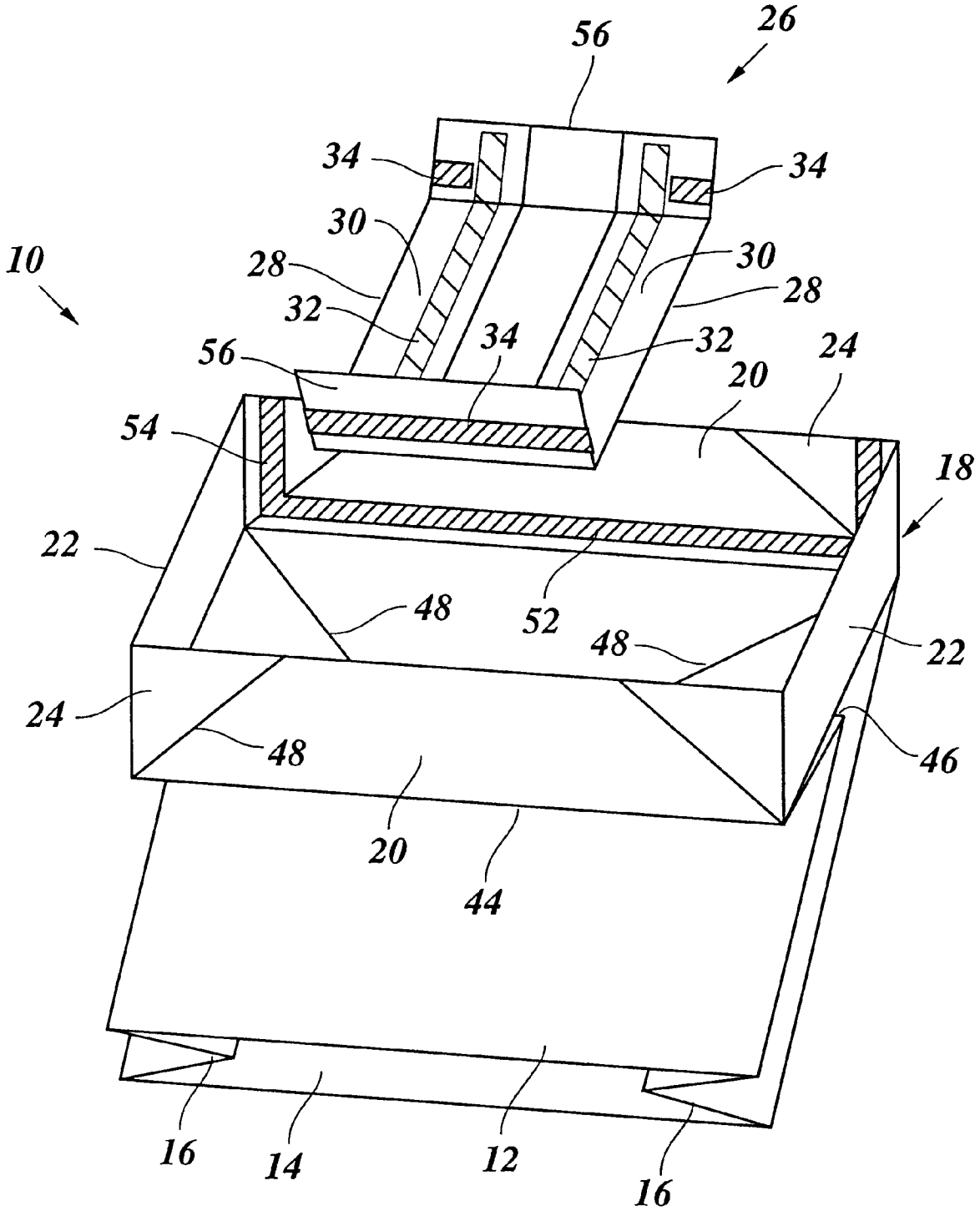
FIG. 4 shows a perspective view of the bottom lining and of the bottom region of the bag immediately before the bottom lining is put in place.

In each case, one bag and one bottom lining meet at a feeding station disposed at the periphery of the bottom-laying drum and the bottom lining 26 is inserted into the bottom opening of the bag in the manner shown in FIG. 4. At the same time, the ends of the bottom lining 26 are bent up into wings 56, so that they lie against the inner surfaces of the trapezoidal flaps 20. In this way, the glue lines 34 of the bottom lining come to lie flush on the glue lines 50 and 52 of the bag.

Subsequently, the bag, with the inserted bottom lining, moves into a bottom-laying station B, in which the trapezoidal flaps 20, which are still upright in FIG. 4, are pulled apart, while the rectangular flaps 22 and the triangular tucks 24 are folded inwards. In this way, the state shown in FIG. 1 results.

By folding over the triangular tucks 24 at the fold lines 28, the legs of the glue lines 52, 54, which extend on these triangular tucks and together form a U, come to lie partly on the base leg of this U and partly on the glue lines 34 of the folded-over flaps 30 of the bottom lining 26. The corresponding also holds good for the legs of the U-shaped glue line 50, which cannot be seen in FIG. 4. Furthermore, the rectangular flaps 22 place themselves on the flaps 30 of the bottom lining that have been provided with hot-melt adhesive.

If, in this state, pressure is exerted, for example, with the help of a contacting roller, on the bottom 18 of the bag clamped onto the bottom-laying drum, the desired glued joints between the bag and the bottom lining are produced.

Subsequently, in a closing station, the trapezoidal flaps 20 are folded over and glued. Optionally, the finished bottom is then rolled once again with a contacting roller. Alternatively, the rolling can also take place only in this stage, so that rolling between the bottom-laying station and the closing station can be omitted.

In the example shown, normal glue is used for the glue lines of the bottom lining, because these glue lines are located only on the upper side of the bottom lining in FIG. 3, so that the glue can be applied without problems without smudging the bottom flaps. Alternatively, however, a contact adhesive can also be used for these glue lines 32. This contact adhesive then interacts with the corresponding glue lines on the rectangular flaps 22.

Figure 5:
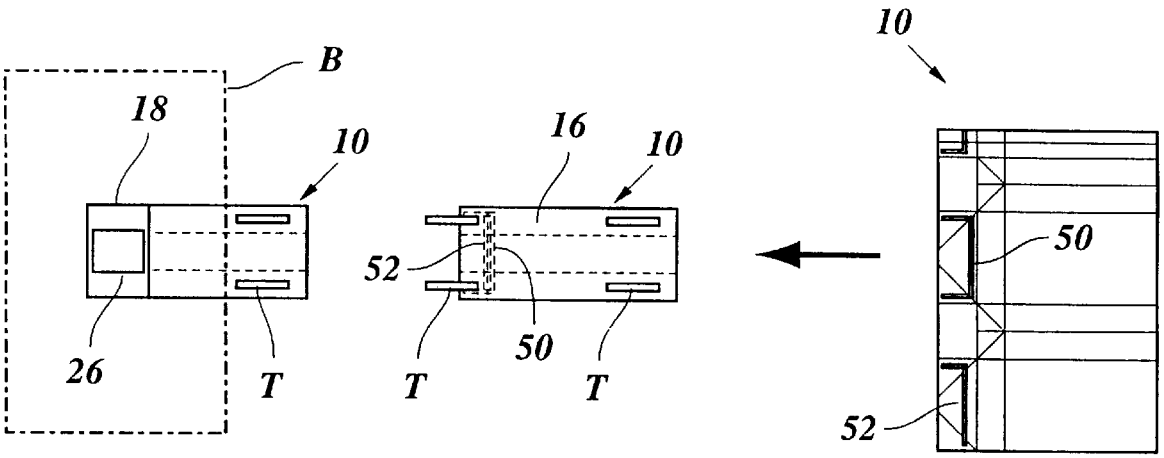
FIG. 5 is a top plan view showing folding of the blank into a tube with glue lines offset from each other and delivering the folded blank to a bottom-laying station.
Figure 6:
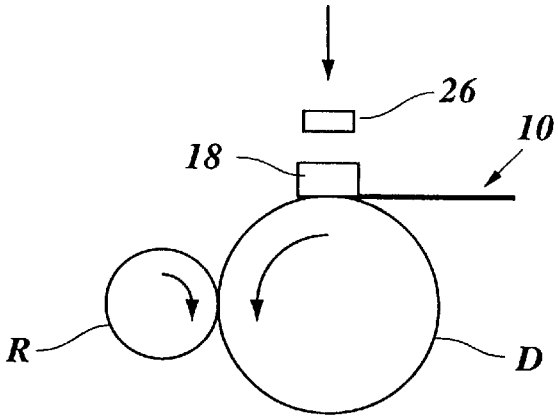
FIG. 6 is a side elevational view of the bottom-laying drum and contacting roller with the bag in a first condition.
Figure 7:
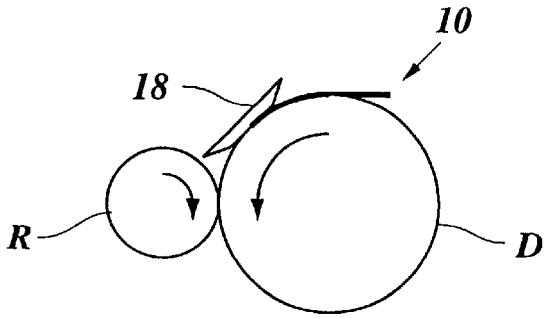
FIG. 7 is a side elevational view of the bottom-laying drum and contacting roller with the bag in a second condition.

In the example of FIG. 3 shown here, the horizontal legs of the glue lines 50, 52 are at the same height. On the other hand, in a modified version of the embodiment such as in FIG. 5, it is also possible to dispose these glue lines offset to one another, so that they are not superimposed when the blank is closed into a tube. In this case, it is possible to have the transporting rollers for transporting the tube or the tube piece take hold of also in the region between the side folds 16 or to use the method for a bag without side folds, for example, for a cross-bottom bag.

What is claimed is:

1. A method for manufacturing flat-bottom bags with a glued-in bottom lining comprising the steps of:

applying a contact adhesive, which develops a desired adhesive force only when two surfaces, both of which are coated with the contact adhesive, are pressed against one another, onto a starting material for the bag and onto a bottom lining to be inserted into the bag;

wrapping said starting material so that opposite edges of the starting material are in contact with each other and adhered by a glue line to form a tube having side folds and which is open at at least one end;

supplying said tube to a bottom-laying station to produce a flat-positioned bottom of said bag, said step of supplying including the step of transporting the tube by a transporting device which takes hold of the tube at a place where contact adhesive-coated surfaces on mutually opposite inner surfaces of the tube are separated from one another by the side folds; and completing gluing by exertion of pressure on the flat-positioned bottom of said bag after the bottom lining has been placed upon said flat-positioned bottom.

2. The method of claim 1, further comprising the steps of:

manufacturing the bag continuously from a sheet-shaped starting material, which is wrapped into said tube, then running said tube over a bottom-laying drum at the bottom-laying station to produce the flat-positioned bottom, and placing the bottom lining into a bottom opening of the tube when the tube is on the bottom-laying drum and a bottom end of the tube is open.

3. The method of claim 1, further comprising the step of exerting pressure on the flat-positioned bottom with the placed bottom lining by rolling at a periphery of the bottom-laying drum.

4. The method of claim 1, further comprising the steps of:

providing the bottom lining on an inside of the tube, facing an interior of the bag, with glue lines of said contact adhesive, which extend parallel to two opposite edges of the bottom lining, providing corresponding glue lines of said contact adhesive on inner surfaces of opposite bottom flaps of the bag, bending over ends of the bottom lining which have been provided with glue lines into wings when the bottom lining is inserted in a bottom opening of the bag such that the wings come to lie against the bottom flaps, and the glue lines of the bottom lining and the glue lines of the bottom flaps contact one another.

5. The method of claim 2, further comprising the step of disposing surfaces of the tube coated with said contact adhesive so that said surfaces are offset from one another on mutually opposite inner surfaces of the tube.

6. The method of claim 2, further comprising the steps of:

providing the bottom lining on an inside of the tube, facing an interior of the bag, with glue lines of said contact adhesive, which extend parallel to two opposite edges of the bottom lining, providing corresponding glue lines of said contact adhesive on inner surfaces of opposite bottom flaps of the bag, bending over ends of the bottom lining which have been provided with glue lines into wings when the bottom lining is inserted in the bottom opening of the bag such that the wings come to lie against the bottom flaps, and the glue lines of the bottom lining and the glue lines of the bottom flaps contact one another.

7. The method of claim 3, further comprising the step of disposing surfaces of the tube coated with said contact adhesive so that said surfaces are offset from one another on mutually opposite inner surfaces of the tube.

8. The method of claim 3, further comprising the steps of:

providing the bottom lining on an inside of the tube, facing an interior of the bag, with glue lines of said contact adhesive, which extend parallel to two opposite edges of the bottom lining, providing corresponding glue lines of said contact adhesive on inner surfaces of opposite bottom flaps of the bag, bending over ends of the bottom lining which have been provided with glue lines into wings when the bottom lining is inserted in a bottom opening of the bag such that the wings come to lie against the bottom flaps, and the glue lines of the bottom lining and the glue lines of the bottom flaps contact one another.

9. A method for manufacturing flat-bottom bags with a glued-in bottom lining comprising the steps of:

applying a contact adhesive, which develops a desired adhesive force only when two surfaces, both of which are coated with the contact adhesive, are pressed against one another, onto a starting material for the bag and onto a bottom lining to be inserted into the bag;

wrapping said starting material so that opposite edges of the starting material are in contact with each other and adhered by a glue line to form a tube which is open at at least one end;

disposing surfaces of the tube coated with said contact adhesive so that said surfaces are offset from one another on mutually opposite inner surfaces of the tube;

supplying said tube to a bottom-laying station to produce a flat-positioned bottom of said bag; and completing gluing by exertion of pressure on the flat-positioned bottom of said bag after the bottom lining has been placed upon said flat-positioned bottom.

10. The method of claim 9, wherein the tube is provided with side folds and further comprising the step of transporting the tube by transporting means which takes hold of the tube at a place where contact adhesive-coated surfaces on mutually opposite inner surfaces of the tube are separated from one another by the side folds.

11. The method of claim 9, further comprising the steps of:

providing the bottom lining on an inside of the tube, facing an interior of the bag, with glue lines of said contact adhesive, which extend parallel to two opposite edges of the bottom lining, providing corresponding glue lines of said contact adhesive on inner surfaces of opposite bottom flaps of the bag, bending over ends of the bottom lining which have been provided with glue lines into wings when the bottom lining is inserted in a bottom opening of the bag such that the wings come to lie against the bottom flaps, and the glue lines of the bottom lining and the glue lines of the bottom flaps contact one another.

12. A method for manufacturing flat-bottom bags with a glued-in bottom lining comprising the steps of:

applying a contact adhesive, which develops a desired adhesive force only when two surfaces, both of which are coated with the contact adhesive, are pressed against one another, onto a starting material for the bag at positions corresponding to inner surfaces of opposite bottom flaps of the bag, and onto a bottom lining to be inserted into the bag;

wrapping said starting material so that opposite edges of the starting material are in contact with each other and adhered by a glue line to form a tube which is open at at least one end;

supplying said tube to a bottom-laying station to produce a flat-positioned bottom of said bag;

providing the bottom lining on an inside of the tube, facing an interior of the bag, with glue lines of said contact adhesive being provided at ends of the bottom lining and extending parallel to two opposite edges of the bottom lining;

wherein said contact adhesive applied to said starting material being provided at positions corresponding to inner surfaces of opposite bottom flaps of the bag;

bending over said ends of the bottom lining which have been provided with glue lines into wings when the bottom lining is inserted in a bottom opening of the bag such that the wings come to lie against the bottom flaps, and the glue lines of the bottom lining and the glue lines of the bottom flaps contact one another; and completing gluing by exertion of pressure on the flat-positioned bottom of said bag after the bottom lining has been placed upon said flat-positioned bottom.

13. The method of claim 12, further comprising the step of providing the bottom lining, on a side, which is an outer side in relation to the bag, and along edges thereof which extend at right angles to the contact adhesive glue lines on the bottom lining, with glue lines, which are glued together with two further bottom flaps of the bag.

14. The method of claim 13, further comprising the step of applying the glue lines on the side of the bottom lining which is the outer side in relation to the bag, on folded-over flaps of a blank for the bottom lining, so that said glue lines are on the same side of the blank as the contact adhesive glue lines on the bottom lining.

15. The method of claim 14, further comprising the steps of:

applying the glue lines of contact adhesive to the bottom flaps in such a manner, that said glue lines extend over the bottom lining and, with angular legs, extend over triangular tucks adjoining the bottom flaps, and causing, when the triangular tucks are folded, the legs of the glue lines to coincide with corresponding sections of the glue lines on the bottom flaps as well as with corresponding sections of the glue lines on the folded-over flaps of the bottom lining.

* * * * *